US012680304B1

(12) United States Patent
Wensley

(10) Patent No.: US 12,680,304 B1
(45) Date of Patent: Jul. 14, 2026

(54) MODULAR I-JOIST NOTCH REINFORCER

(71) Applicant: Daniel G Wensley, Roanoke, VA (US)

(72) Inventor: Daniel G Wensley, Roanoke, VA (US)

( * ) Notice: Subject to any disclaimer, the term of this patent is extended or adjusted under 35 U.S.C. 154(b) by 114 days.

(21) Appl. No.: 18/401,688

(22) Filed: Jan. 1, 2024

Related U.S. Application Data

(60) Provisional application No. 63/478,063, filed on Dec. 30, 2022.

(51) Int. Cl.
*E04C 3/14* (2006.01)

(52) U.S. Cl.
CPC ..... *E04C 3/145* (2013.01)

(58) Field of Classification Search
CPC ... E04C 3/12; E04C 3/14; E04C 3/145; E04G 23/0244; E04G 23/0218; E04B 5/12
See application file for complete search history.

(56) References Cited

U.S. PATENT DOCUMENTS

| | | | | |
|---|---|---|---|---|
| 6,176,057 | B1 * | 1/2001 | Bouchet | E04B 2/80 52/514 |
| D477,210 | S * | 7/2003 | Callahan | D8/349 |
| 7,347,031 | B2 * | 3/2008 | Callahan | E04G 23/0218 52/220.8 |
| 10,519,657 | B1 * | 12/2019 | Callahan | E04C 3/145 |
| 2004/0200180 | A1 * | 10/2004 | Davis | E04C 3/145 52/831 |

* cited by examiner

*Primary Examiner* — Christine T Cajilig
(74) *Attorney, Agent, or Firm* — Johnston Holroyd; Mary-Jacq Holroyd

(57) ABSTRACT

An i-joist web plate 14 has a notch 18 at the top 24, and an i-joist notch flange 16 formed from a C-shape in which the ends are bent three times forming walls 26, 28, 30, and 32. The first wall 26 bridging the notch in which each of the ends of the C-shape has three walls 28, 30, and 32, and a plurality of openings 22 disposed in the web plate 14 with openings 22 along the top 24 thereof that correspond to the plurality of openings 22 in the fourth walls 32 of the notch flange 16.

20 Claims, 6 Drawing Sheets

MODULAR I-JOIST NOTCH REINFORCER

REFERENCE TO RELATED APPLICATIONS

This application claims the benefit of U.S. Provisional Application Ser. No. 63/478,063 entitled "Modular Joist and Truss Repair System" filed on 30 Dec. 2022, the contents of which are incorporated herein by reference in its entirety.

COPYRIGHT NOTICE

A portion of the disclosure 22 of this patent document may contain material which is subject to copyright protection. The copyright owner has no objections to the facsimile reproduction by anyone of the patent document or the patent disclosure as it appears in the Patent and Trademark Office patent file or records, but otherwise reserves all copyright rights whatsoever.

BACKGROUND OF THE INVENTION

I-joists are modern manufactured wood joists which are stronger than conventional wood joists requiring less weight/thickness than conventional wooden joists and eliminating some problems of conventional wooden joists, e.g., weight and twisting. I-joists may come in a variety of sizes, but most likely have a joist height of 9.5", 11⅞", 14" or 16" with flange F width being 1.5", 2.5" or 3.5".

Residential floor systems consist of a linear array of horizontal support members, such as i-joists, upon which sheathing is attached to create a floor. The support members are supported by perimeter walls with intermediate support columns and beams, where needed to meet requirements for floor span, loads, deflection, and stiffness. The floor system divides the space into upper and lower spaces, with the floor system interstitial space in between. This interstitial space is usually between 7" and 13".

The interstitial compartments can be used for the routing of utilities such as plumbing, electrical, ductwork for heating and cooling, as well as low voltage cabling. When these utilities need to cross or traverse from one or a series of linear compartments, it may be advantageous to cut notches through the i-joists for the purpose of routing the utilities. Utility lines such as HVAC, plumbing, electrical, telecommunication, gas and water to be placed in interstitial space between floors, allowing access from both above and below to equipment, appliances and plumbing fixtures. The linear nature of floor i-joists requires that holes or notches be cut into the structural members supporting the floor to allow for the passage of utility lines running perpendicular to its members.

Prior efforts to reinforce i-joists with notches. U.S. Pat. No. 7,347,031B2 issued to Callahan on 25 Mar. 2008 teaches a joist reinforcing bracket which is designed to reinforce an i-joist with a unitary design bracket that has flanges extending from both top and bottom of a web plate, covering both of the opposing flanges of the i-joist, and a cross brace welded onto the web plate for extra strength. A different bracket must be manufactured for each combination of i-joist (web) width and i-joist flange width which requires 12 different sizes of the joist reinforcing bracket to meet the needs of standard i-joists. Similar design patents, such as US Design Pat. No. D472791 D472792 also issued to Callahan et al. for a joist reinforcing brackets shows a unitary i-joist fitting brackets each with a cross brace.

SUMMARY OF THE INVENTION

The present invention is an i-joist web notch reinforcer 12, according to the present application is designed to an i-joist web plate 14 has a notch 18 at the top 24, and an i-joist notch flange 16 formed from a C-shape in which the ends are bent three times forming walls 26, 28, 30, and 32. The first wall 26 bridging the notch 18 in which each of the ends of the C-shape has three walls 28, 30, and 32, and a plurality of openings 22 disposed in the web plate 14 with openings 22 along the top 24 thereof that correspond to the plurality of openings 22 in the fourth walls 32 of the notch flange 16.

An advantage of the present invention is that web reinforcer plate 14 may be used with each common i-joist products.

An advantage of the present invention is that the notch flange 16 comes in three common sizes.

Another advantage of the present invention is that the web plate 14 is separate from the notch flange 16 and different notch flanges 16 can be used with the web plate 14.

Yet another advantage of the present invention is that the notch flange 16 adds another dimension of support directly to the sheathing or flooring.

These and other aspects of the present invention will become readily apparent upon further review of the following drawings and specification.

BRIEF DESCRIPTION OF DRAWINGS

The novel features of the described embodiments are specifically set forth in the appended claims; however, embodiments relating to the structure and process of making the present invention, may best be understood with reference to the following description and accompanying drawings.

Similar reference characters denote corresponding features consistently throughout the attached drawings.

DETAILED DESCRIPTION OF THE INVENTION

Figure 1:
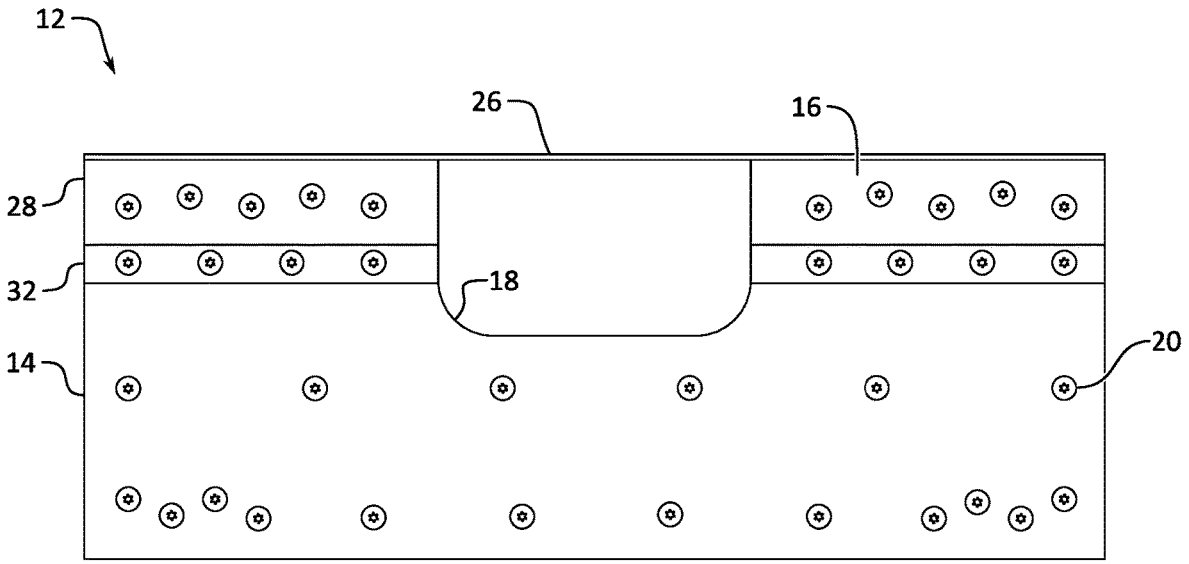
FIG. 1 is front view of an i-joist web notch reinforcer 12 according to an embodiment of the present invention with the web plate 14 and the notch flange 16 with the notch 18 showing the web plate 14 and the notch flange 16 and fastener 20 position.
Figure 2:
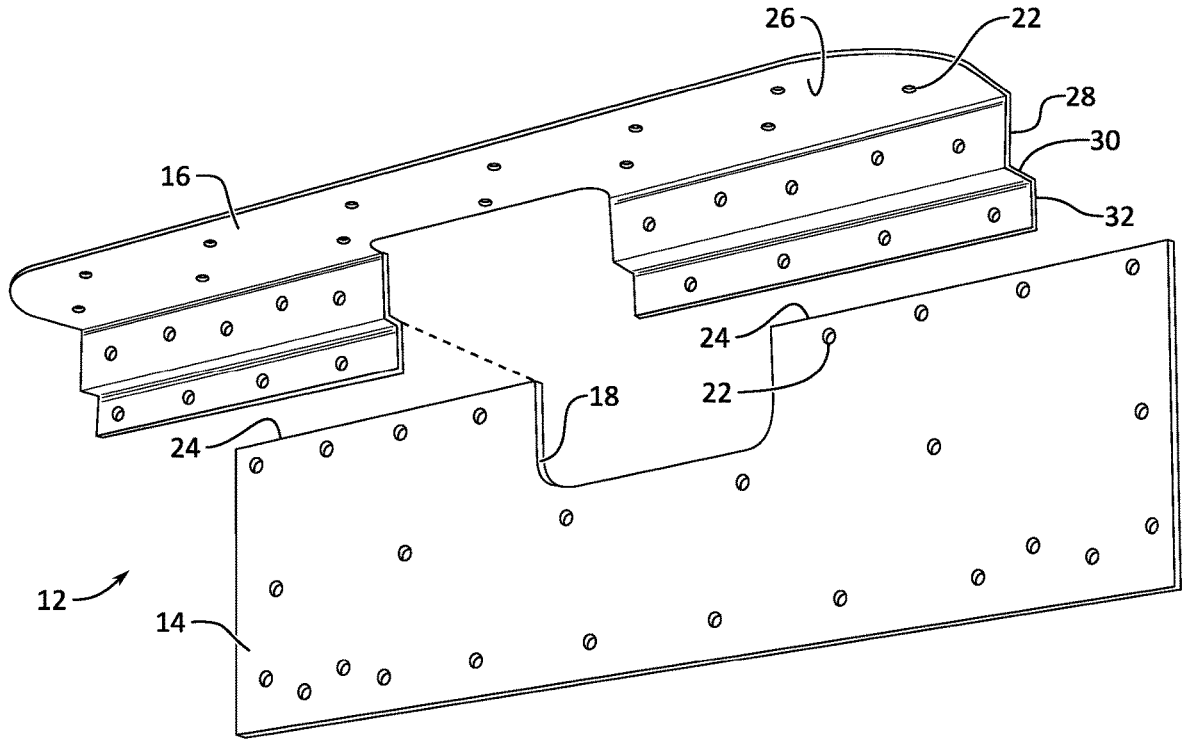
FIG. 2 is an exploded view of an i-joist web notch reinforcer 12 according to an embodiment of the present invention with the web plate 14 and the i-joist notch flange 16 separated showing the plurality of openings and corresponding plurality of openings 22 in the top of the web plate 14 corresponding to the openings 22 with the fasteners 20 through the wall 32 at the top 24 of the web plate 14.

An i-joist notch reinforcer 12 according to the present invention, shown in FIGS. 1 and 2, is designed to reinforce a notch N in an i-joist J in which the notches are cut into the i-joist flange F and down into the i-joist web J. The i-joist notch reinforcer 12 has an i-joist web plate 14 with a notch 18 at the top 24. An i-joist notch flange 16 is formed from a flat C-shaped cut of a sheet of steel in which the ends C-shape are bent three times forming walls 26, 28, 30, and 32, as shown in FIG. 2. The first wall 26 bridges the notch 18 in the i-joist web plate 14. Each of the ends of the C-shape has three walls 28, 30, and 32, and a plurality of openings 22 disposed in the web plate 14 with openings 22 along the top 24 thereof that correspond to the plurality of openings 22 in the fourth walls 32 of the notch flange 16.

The i-joist notch reinforcers 12 modular kit fits i-joists with flange widths of 1½", 2 ½", and 3½" (also, 1.5", 2.5", and 3.5") and notches upto 6" wide to 4" deep. Conventional i-joists have overall heights of 9½", 11⅞", 14" and 16". Nearly all I-Joist manufacturers conform to these common sizes. I-Joist notch reinforcers 12 are designed for engineered I-Joists J requiring notches N for utilities U such as plumbing and HVAC. The i-joist flange F width refers to the dimension of the top and bottom solid lumber flanges F typically 1.5", 2.5" or 3.5" wide, but do often very slightly.

An i-joist web notch reinforcer 12 according to an embodiment of the present invention shown in FIG. 1 with the web plate 14 with the notch 18 and the notch flange 16. The web plate 14 and the notch flange 16 and fastener 20 positions. The exploded view of an i-joist web notch reinforcer 12 shown in FIG. 2 shows the web plate 14 and the i-joist notch flange 16 separately. The plurality of openings 22 in the web plate 14 at the top 24 which match the corresponding plurality of openings 22 in the wall 32 of the notch flange 16. The fasteners 20 are installed through the wall 32 in the notch flange 16 and the top 24 of the web plate 14 with the notch flange 16 disposed as shown in FIG. 1.

Figure 3A:
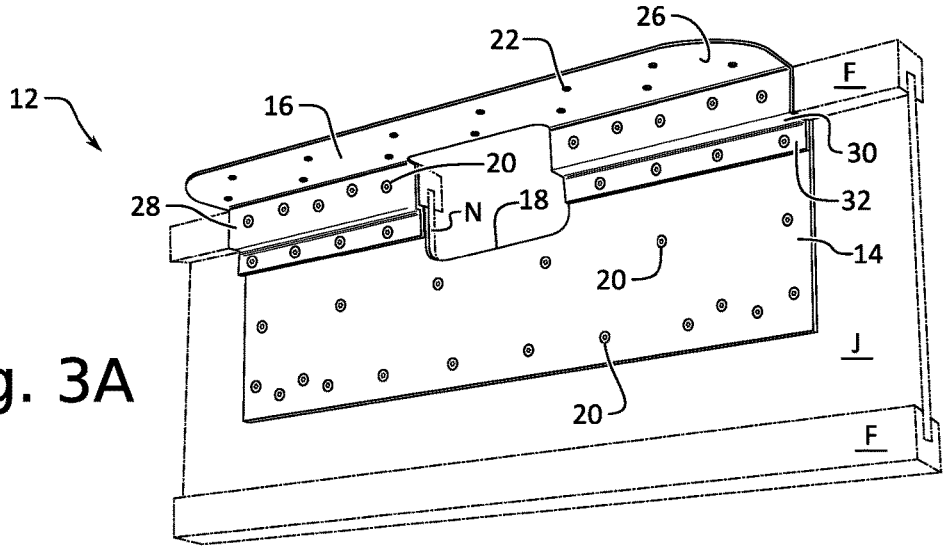
FIGS. 3A-3E show the i-joist notch reinforcer 12 according to an embodiment of the present invention in which the i-joist notch flange 16 has a third wall 30 width to match the width of 1.5" i-joist flange F.
Figure 3B:
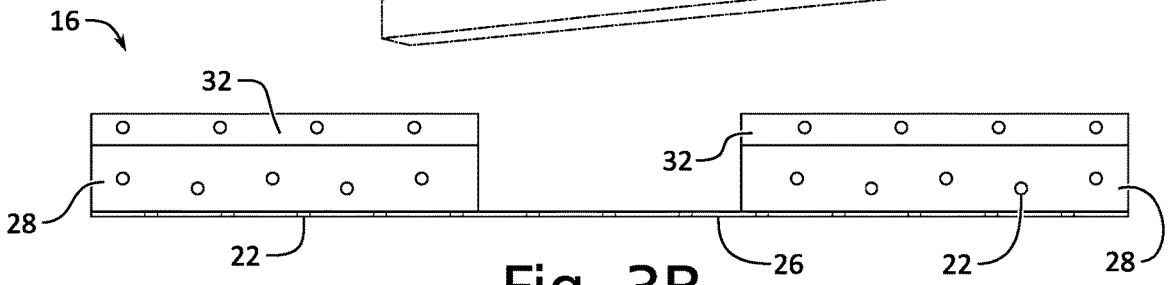
Figure 3C:
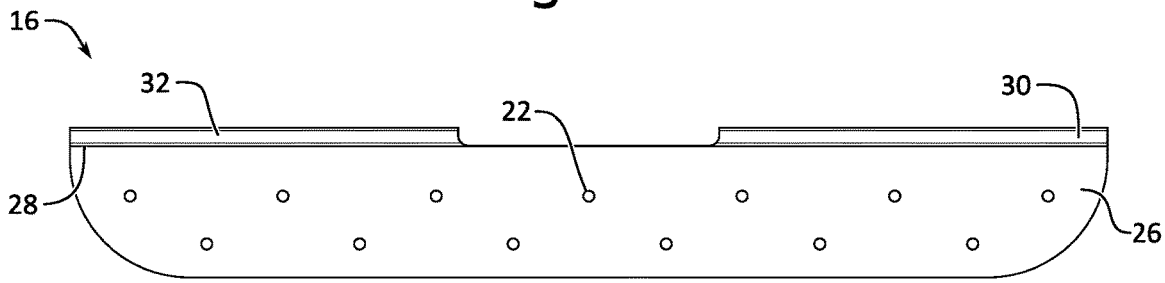
Figure 3D:
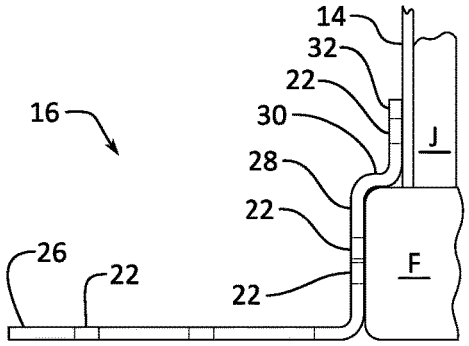
Figure 3E:
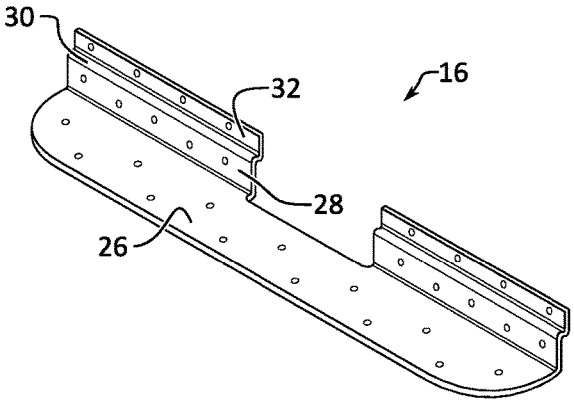

The i-joist notch reinforcer 12 shown in FIGS. 3A-3E is an embodiment of the present invention in which the i-joist notch flange 16 has a third wall 30 width to match the width of an i-joist J with a 1.5" flange F. A perspective view of the i-joist notch reinforcer 12 installed on an i-joist J is shown in FIG. 3A. FIG. 3B shows the notch flange 16 from directly in front with the first wall 26 shown on edge and the second and fourth walls 28 and 30 are shown from directly before them showing the plurality of openings through which the fasteners 20 are used to affix the notch flange 16 and plate 14 to the i-joist J about the flange F. FIG. 3C shows the notch flange 16 from above the notch flange 16 first wall 26 so that the third wall 30 can be seen more clearly. It is the third wall 30 that is different in the alternative embodiments, as this is where the different widths in the flanges F are matched. FIG. 3D shows the relationship between the many walls 26, 28, 30, and 32 and the i-joist flange F and the i-joist J and the web plate 14. FIG. 3E is a perspective view of the notch flange 16.

Figure 4A:
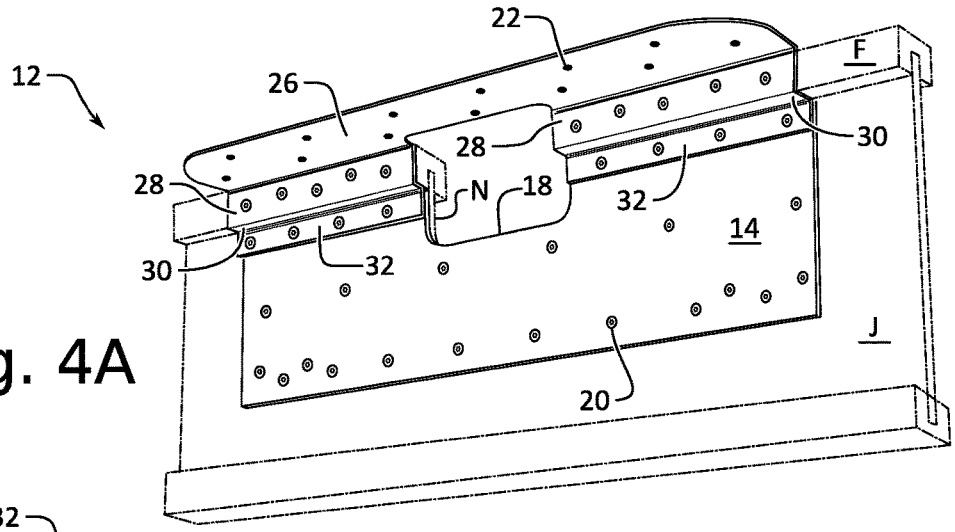
FIGS. 4A-4E show the i-joist notch reinforcer 12 according to an embodiment of the present invention in which the i-joist notch flange 16 has a third wall 30 width to match the width of 2.5" i-joist flange F.
Figure 4B:
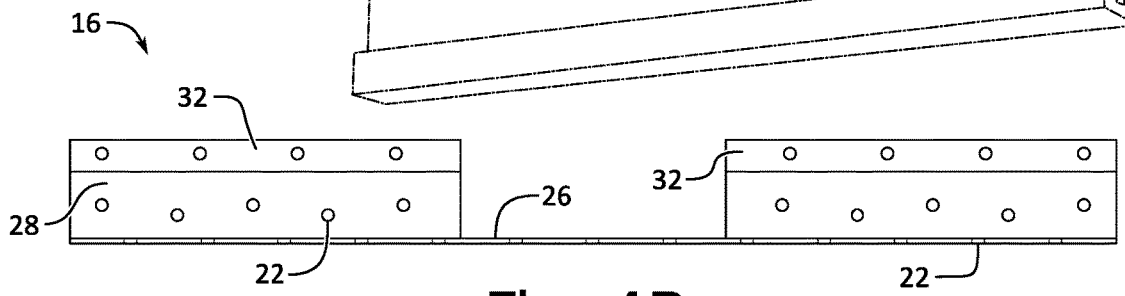
Figure 4C:
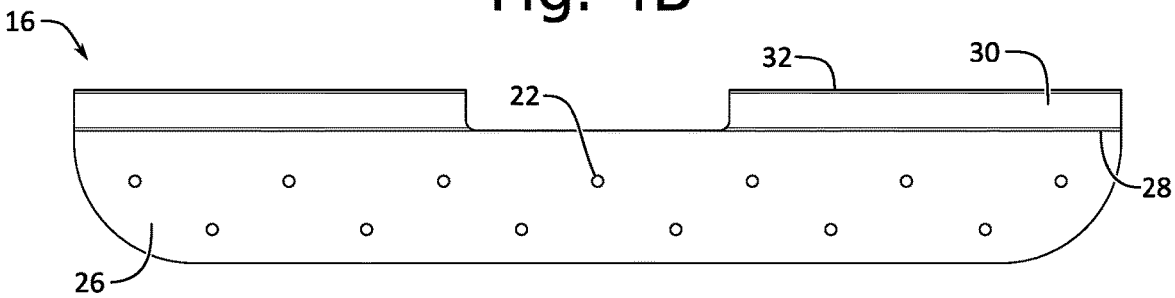
Figure 4D:
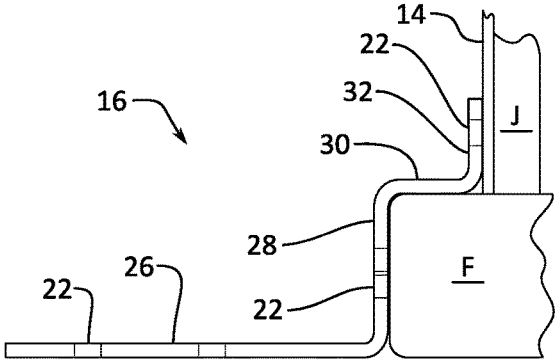
Figure 4E:
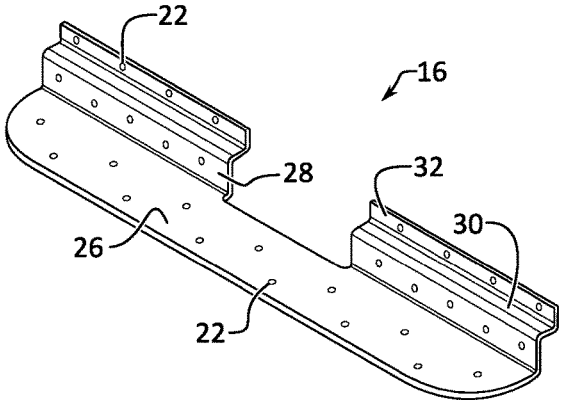
Figure 5A:
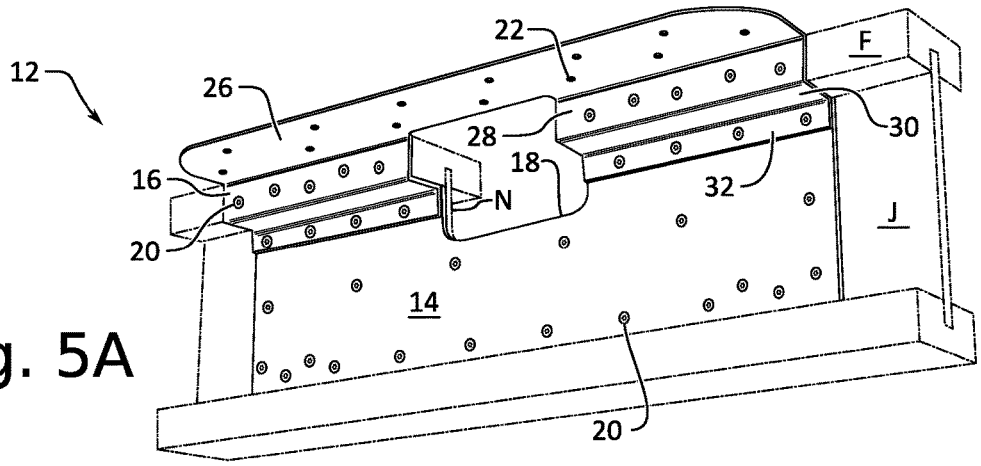
FIGS. 5A-5E show the i-joist notch reinforcer 12 according to an embodiment of the present invention in which the i-joist notch flange 16 has a third wall 30 width to match the width of 3.5" i-joist flange F.
Figure 5B:
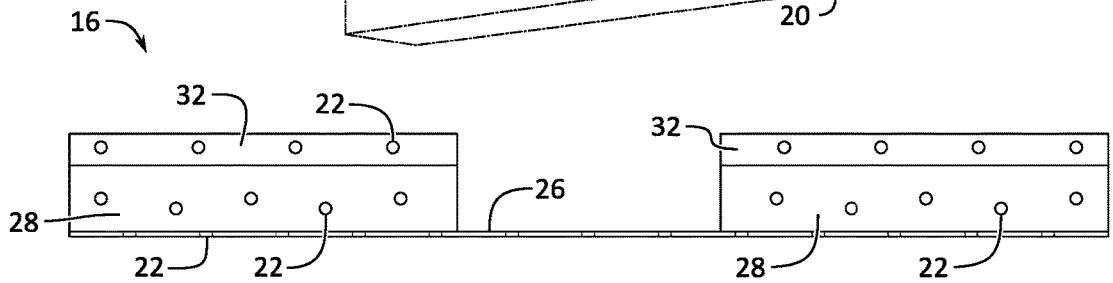
Figure 5C:
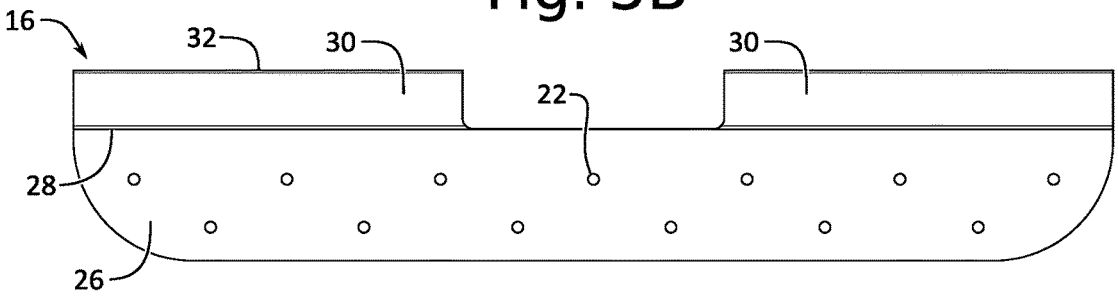
Figure 5D:
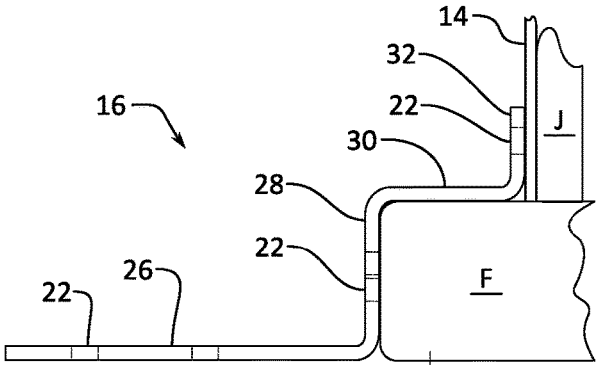
Figure 5E:
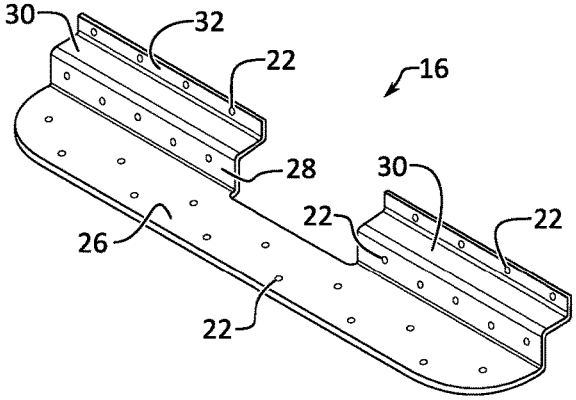

Similarly, FIGS. 4A-4E show the i-joist notch reinforcer 12 in which the notch flange 16 has a third wall 30 width to match the width of 2.5" i-joist flange F as shown in profile in FIG. 4D. FIGS. 5A-5E show the i-joist notch reinforcer 12 in which the i-joist notch flange 16 has a third wall 30 width to match the width of 3.5" i-joist J flange F as shown in profile in FIG. 5D.

Figure 6:
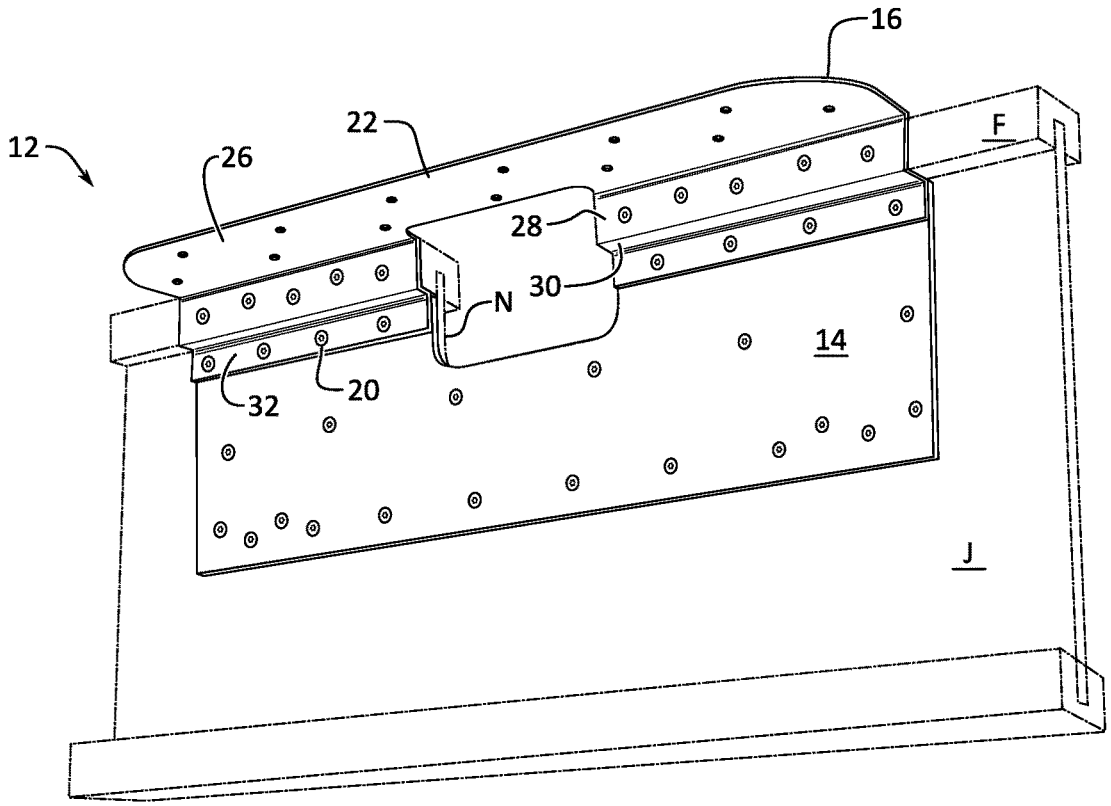
FIG. 6 is an environmental perspective view of an i-joist notch reinforcer 12 according to an embodiment of the present invention demonstrating a different sized i-joist J.
Figure 7:
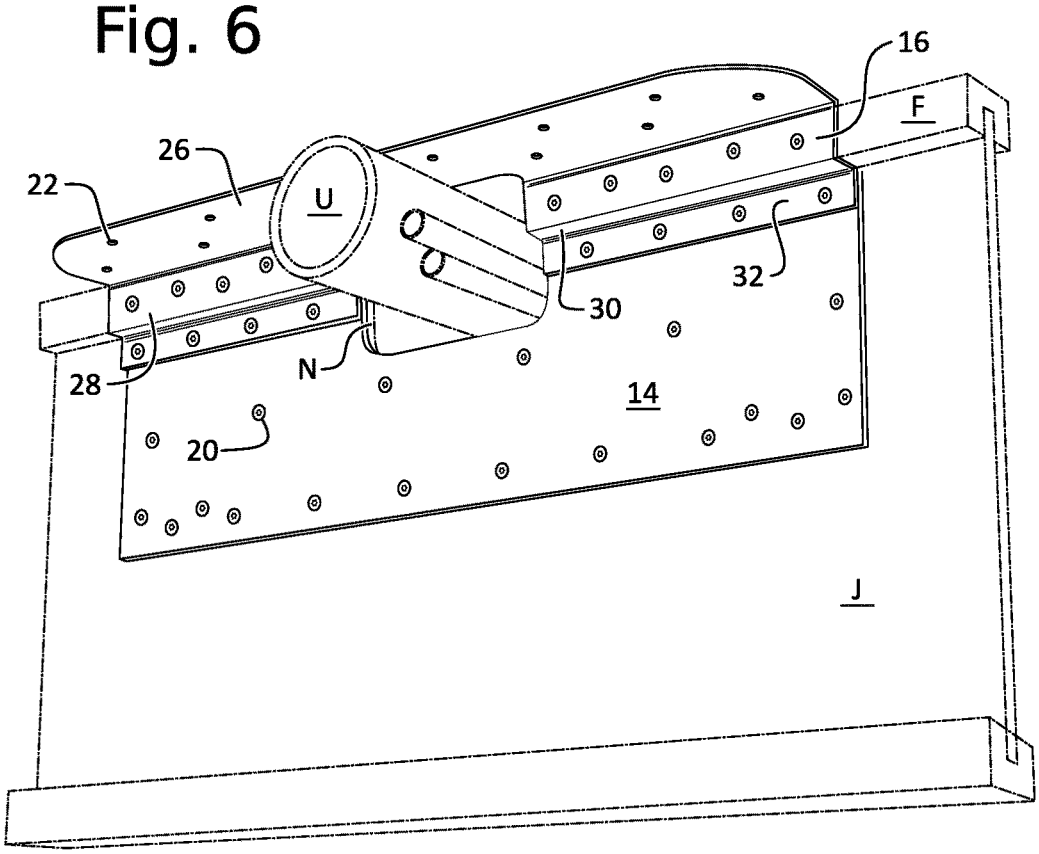
FIG. 7 is another environmental perspective view of an i-joist notch reinforcer 12 according to an embodiment of the present invention on a different sized i-joist J.
Figure 8:
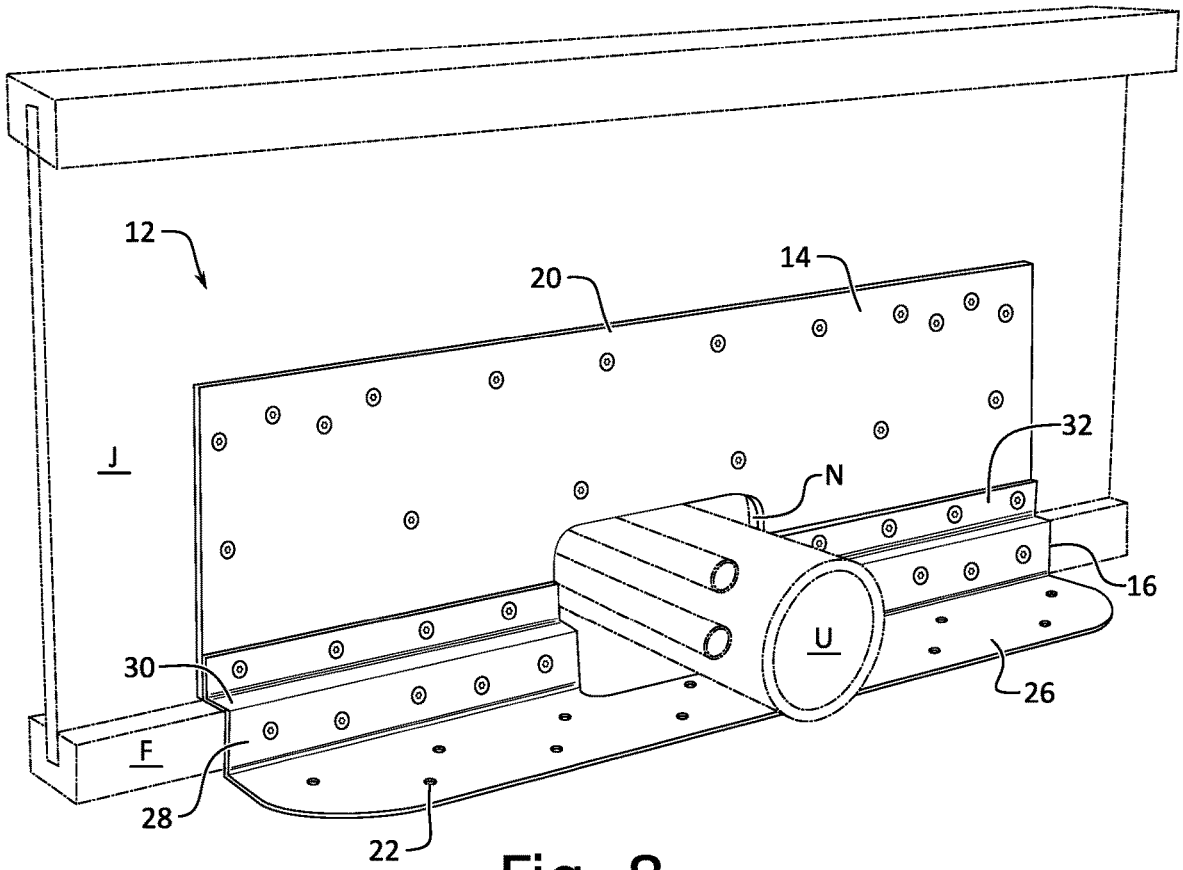
FIG. 8 is an environmental view of an i-joist notch reinforcer 12 demonstrating an alternative orientation as installed and used with utilities U extending through the notch 18 according to an embodiment of the present invention.

FIG. 6 is an environmental perspective view of an i-joist notch reinforcer 12 demonstrating that different sized i-joists J can be repaired by the present invention. FIG. 7 is another environmental perspective view of an i-joist notch reinforcer 12 on a different sized i-joist J. FIG. 8 is an environmental view of an i-joist notch reinforcer 12 demonstrating an alternative orientation as installed and used with utilities U extending through the notch 18 according to an embodiment of the present invention.

Examples of i-joist notch reinforcers 12 are made from 10 gauge galvanized steel and are designed to reinforce 1.5", 2.5", and 2.5" i-joist flange F widths. The steel plate thickness is 10 Ga, overall width 23.75", and nominal i-joist heights of 9.5", 11⅞", 14", and 16", and designed for all major brand i-joists J, including, but not limited to the following: BCI-Boise Cascade I-Joist, LP-Louisiana Pacific I-Joist, TJI-Trus Joist Weyerhaeuser I-Joist, GP-Georgia Pacific Wood Beam I-Joist, and Roseburg RFPI Forest Products I-Joist. All i-joist reinforcers accommodate a 5" wide×3.25" deep notch commonly required for an offset toilet flange, but will allow the passage of any utility less than 3.25".

Installation Instructions for an i-joist notch reinforcer 12 using a kit that includes one web plate 14, one notch flange 16, 14 Torx structural fasteners 20, a 3⁄16" pilot drill bit, and a Torx T25 driver. When installed according to instructions, the i-joist notch reinforcer 12 is designed to restore the full strength of i-joists assuming that the maximum floor dead load is 12 Pounds per square foot (PSF) and maximum live load is 40 PSF, the flange F and i-joist web J substrate removed does not exceed the notch opening 18 provided by the i-joist notch reinforcer 12, the i-joist J spacing is 16" on center or less (if greater that 16", the i-joist notch reinforcer 12 is still beneficial and may restore full strength to the i-joist J depending on the length of the i-joist span). The i-joist J sizing and span is in accordance with good engineering practices and/or tables provided in the building code.

The reinforcer 12 may be installed with the notch 18 either up, or down. Construction adhesive is not required but can be used. Fasteners will protrude through the web substrate which is acceptable, however wood may be used on the opposite side of the i-joist J for fastener 20 penetration. For installation with notch flange 16 against the underside of the floor, though not required, fasteners 20 may be installed to secure the first wall 26 of the notch flange 16 to the floor above for additional compression support. The fasteners 20 for this are not provided for in the kit content referenced hereinbefore.

Installation Instructions positioning the steel i-joist notch flange 16 on the i-joist flange F centered on the opening. Install one fastener on each end of the steel Flange leaving the fasteners loose enough to allow a small amount of play. Place the Web Plate against the substrate and slide it behind the Flange. Use one fastener at each end of the Web Plate and attach it the through the steel Flange. Install a fastener at each outside lower corner of the Web Plate. Leave the fasteners loose enough to allow a small amount of play. Complete the installation by (a) tightening loose fasteners 20, (b) pre-drilling holes through the openings 22 and installing the remaining fasteners 20 and tightening all fasteners 20.

It is to be understood that the present invention is not limited to the embodiments described above, but encompasses any and all embodiments within the scope of the following claims.

The invention claimed is:

1. An i-Joist notch reinforcer (12) for reinforcing a web and flange (F) of an i-Joist (J), comprising:

an i-joist web plate (14) and an i-joist notch flange (16);

the i-joist web plate (14) having a notch (18) disposed in the middle of the top (24) thereof;

the i-joist notch flange (16) formed from a C-shaped cut of sheet material in which the ends of the C-shape are bent three times forming walls, a first wall (26), a second wall (28), a third wall (30), and a fourth wall (32), in which each wall (26), (28), (30), or (32), has a length and a width, the first wall (26) bridging the notch (18) between the two ends of the C-shape;

each of the ends of the C-shape having three of the walls, the second wall (28), the third wall (30), and the fourth wall (32), the second wall (28) and the fourth wall (32) have a plurality of openings along the lengths thereof, a corresponding plurality of openings (22) are disposed in the i-joist web plate (14) with openings (22) disposed along the top (24) thereof that correspond to the plurality of openings in the fourth wall (32) of each of the ends of the C-shape of the notch flange (16).

2. The i-joist notch reinforcer (12) of claim 1, wherein:

some of the plurality of openings in the web plate (14) opposite the notch (18) and the top (24) have a pattern.

3. The i-joist notch reinforcer (12) of claim 1, wherein:

the third wall (30) has a width corresponding to a width of the flange (F) of the i-joist (J).

4. The i-joist notch reinforcer (12) of claim 2, further comprising:

a plurality of openings (22) in the first wall (26) of the notch flange.

5. The i-joist notch reinforcer (12) of claim 2, wherein:

the pattern in the plurality of openings (22) are mirror reflections of each other, as defined by a vertical plane centered through a weak region of the flange (F) of the i-joist (J).

6. The i-joist notch reinforcer (12) of claim 1, wherein:

the second wall (28) of the notch flange (16) has the plurality of openings (22) disposed along the length thereof in a staggered pattern.

7. The i-joist notch reinforcer (12) of claim 1, wherein:

the third wall (30) being blank with no openings (22) therethrough.

8. The i-joist notch reinforcer (12) of claim 1, further comprising:

a plurality of fasteners (20) that fit the plurality of openings (22).

9. The i-joist notch reinforcer (12) of claim 1, wherein:

the third wall (30) of the notch flange (16) correspond to around about 1.5", about 2.5", and about 3.5" i-joist flange (F) widths.

10. The i-joist notch reinforcer (12) of claim 1, wherein:

the third wall (30) of the notch flange (16) is blank with no openings (22).

11. A method for reinforcing an i-joist (J) flange (F) comprising:

providing an i-joist notch reinforcer (12) with an i-joist web plate (14) and an i-joist notch flange (16), the i-joist web plate (14) having a notch (18) disposed in the middle of the top (24) thereof, the i-joist notch flange (16) formed from a C-shaped cut of sheet material in which the ends of the C-shape are bent three times forming walls, a first wall (26), a second wall (28), a third wall (30), and a fourth wall (32), in which each wall (26), (28), (30), or (32), has a length and a width, the first wall (26) bridging the notch (18) between the two ends of the C-shape, each of the ends of the C-shape having three of the walls, the second wall (28), the third wall (30), and the fourth wall (32), the second wall (28) and the fourth wall (32) have a plurality of openings along the lengths thereof, a plurality of corresponding openings (22) are disposed in the i-joist web plate (14) with openings (22) disposed along the top (24) thereof that correspond to the plurality of openings in the fourth wall (32) of each of the ends of the C-shape of the notch flange (16);

positioning the notch flange (16) on the i-joist (J) Flange (F) centered on a weak region of the i-joist;

installing one fastener (20) on each end of the notch flange (16) leaving fasteners loose enough to allow a small amount of play;

placing web plate (14) against the i-joist web (J) and slide it behind the fourth wall (32) of the notch flange (16) using one fastener (20) at each end of the web plate (14) and attach it through the notch flange (16);

install a fastener (20) at each outside lower corner of the web plate (14) leaving the fasteners (20) loose enough to allow a small amount of play;

tightening loose fasteners (20), and installing and tightening all fasteners (20).

12. The method for reinforcing an i-joist (J) of claim 11, further comprising:

construction adhesive disposed between web plate (14) or notch flange (16) and the i-joist (J).

13. The method for reinforcing an i-joist (J) of claim 11, wherein:

the notch (18) is oriented either up or down at a top or bottom flange (F) of an i-joist (J).

14. The method for reinforcing an i-joist (J) of claim 11, further comprising:

fasteners (20) for the first wall (26) to a floor above.

15. The method for reinforcing an i-joist (J) of claim 11, further comprising:

predrilling holes through the openings (22) into the i-joist and installing the remaining fasteners (20) and tightening all fasteners (20).

16. An i-Joist notch reinforcer (12), comprising:

an i-joist web plate (14) and an i-joist notch flange (16);

the i-joist web plate (14) having a notch (18) disposed in the middle of the top (24) thereof;

the i-joist notch flange (16) formed from a C-shaped cut of sheet material in which the ends of the C-shape are bent three times forming walls, a first wall (26), a second wall (28), a third wall (30), and a fourth wall (32) in which each wall (26), (28), (30), or (32), has a length and a width, the first wall (26) bridging the notch (18) between the two ends of the C-shape;

each of the ends of the C-shape having three of the walls the second wall (28), the third wall (30), and the fourth wall (32), the second wall (28) and the fourth wall (32) have a plurality of openings (22) along the length thereof, a plurality of openings (22) are disposed in the i-joist web plate (14) with openings (22) disposed along the top (24) thereof that correspond to the plurality of openings in the fourth wall (32) of each of the ends of the C-shape of the notch flange (16);

wherein the third wall (30) has a width corresponding to a standard width of a flange (F) of an i-joist (J).

17. The i-joist notch reinforcer (12) of claim 16, wherein:

some of the plurality of openings in the web plate (14) opposite the notch (18) and tops (24) has a pattern.

18. The i-joist notch reinforcer (12) of claim 17, wherein:

the pattern in the plurality of openings (22) are mirror reflections of each other, as defined by a vertical plane centered through a weak region of the i-joist.

19. The i-joist notch reinforcer (12) of claim 16, wherein:

the second wall (28) of the notch flange (16) has the plurality of openings (22) disposed along the length thereof in a staggered pattern; or a plurality of openings (22) in the first wall (26) of notch flange; or the third wall (30) being blank with no openings (22) therethrough; or combinations thereof.

20. The i-joist notch reinforcer (12) of claim 1, further comprising:

a plurality of fasteners (20) that fit the plurality of openings (22).

* * * * *